United States Patent [19]

Bernard

[11] Patent Number: 4,751,890

[45] Date of Patent: Jun. 21, 1988

[54] BOAT SAILS MOUNTED ON WINDING BOOMS

[76] Inventor: René G. Bernard, 15, Avenue Berthelot, 69007 Lyon, France

[21] Appl. No.: 16,393

[22] Filed: Feb. 19, 1987

[30] Foreign Application Priority Data

Feb. 27, 1986 [FR] France ..... 86 02958

[51] Int. Cl.[4] ..... B63H 9/10

[52] U.S. Cl. ..... 114/103; 114/106

[58] Field of Search ..... 114/102–107

[56] References Cited

U.S. PATENT DOCUMENTS

| | | | |
|---|---|---|---|
| 2,378,877 | 6/1945 | Waller | 114/103 |
| 2,565,219 | 8/1951 | Gardiner et al. | 114/103 |
| 3,260,230 | 7/1966 | Kauert | 114/102 |
| 3,285,215 | 11/1966 | Potter | 114/106 X |
| 4,196,687 | 4/1980 | Newick | 114/107 X |

FOREIGN PATENT DOCUMENTS

| | | | |
|---|---|---|---|
| 2557852 | 7/1985 | France | 114/106 |

*Primary Examiner*—Sherman D. Basinger

*Attorney, Agent, or Firm*—Bacon & Thomas

[57] ABSTRACT

The invention relates to an improvement in boat sails, which consists in providing one of the faces of the sail, and over at least part of the length of its leech, with a flat reinforcement which is thick with respect to the sail, and which is made from an elastically deformable material, the reinforcement being substantially constant and extending from the leech and in parallel thereto. The invention finds an application with sails mounted on a winding boom.

8 Claims, 3 Drawing Sheets

BOAT SAILS MOUNTED ON WINDING BOOMS

The present invention is concerned with the technical field of setting and adjusting a boat sail and more particularly a mainsail.

The technical field to which the invention more particularly refers is that of sails mounted on a mast while being operationally coupled to a winding boom which by rotation, permits the full setting of the sail, or its adjustment by reduction of the exposed surface.

A sail of this type is constituted, as can be seen in FIG. 1 which illustrates the prior art, by a panel of sailcloth 1, which is generally triangular-shaped. The panel 1 is equipped along its hoist side 2 and its edge 3, with cords which are designed to cooperate with bolt ropes carried by the mast 4 and with a winding boom 5 adapted at one end for pivoting on the mast 4 via driving means 6.

Said panel 1 comprises, in its angles, respectively called tacks 7, clew 8 and sail head 9, with local reinforcements 10, 11 and 12, constituted by a plurality of layers of cloth locally overlaid and secured by sewing. The sheet reinforcement 11 is generally that which, because of the stresses to which it is subjected, has the greatest number of folds or layers, and the greatest reinforced surface.

The third side of the sail, or leech, designated by reference 13 is, in many cases, bordered by a reinforcing hem which may often contain a leech cord, not shown in the drawings.

The setting of a sail such as described hereinabove requires the use of a spanker-boom 14 for support between the mast head 4 and the free end of boom 5, said spanker-boom being in the form of a cylindrical mandrel which, when driven in rotation from the position illustrated in FIG. 1 ensures the rolling up of the sail 1.

The fitting, such as described hereinabove, raises one specific winding problem which it is the object of the present invention to eliminate.

In general, it is customary to select a diameter of the boom 5 which is proportional to the dimensions of the sail 1, so that the sail can be entirely rolled up in about thirty turns. It is precisely from that relatively large number of turns that problems will arise, in that the occurrence of localized variations of thickness of sail will impair the regular winding of the sail.

As recalled hereinabove, the sail 1 is provided, along its hoist side 2, with a bolt rope tape and a cord, both of which represent an extra thickness. If the sail has been correctly cut, the bolt rope cord will wind up on the boom 5 in a spiral with jointed spires spreading out rearwardly for about ten to twelve turns, as illustrated by reference $H_1$ in FIG. 2. Because of the tension created by the helical displacement, the winding of the cord is thereafter going to reverse, giving a spiral with jointed spires $H_2$ spreading out forwardly for about another ten turns, at the end of which the winding is reversed back to jointed spires spreading out backwardly according to reference $H_3$. The result is, as illustrated in FIG. 2, a winding in three successive layers, close-wound and of increasing diameter, in the corresponding part of the boom.

It is therefore conceivable that the local extra thickness, showed by the boom, corresponds, for each turn, substantially to the extra thickness of the tape and of half the thickness of the bolt rope cord.

On the contrary, the winding of sail 1 does not proceed in the same way, as far as the leech 13 is concerned. Indeed, the surface of the clew reinforcement is such that its winding up normally takes three or four turns, giving considerably thicker spires than the corresponding spires formed by the winding of the extra thickness of the hoist side. This is due to the large number of reinforcing folds or layers overlaid in that area.

In a first winding phase, the winding perimeter increases therefore quicker towards the back of the boom than towards the front, so that the sail leech 13 shortens quicker than the hoist side 2. This is clearly illustrated in FIGS. 3 and 4, which show that, as a result of the increase in the winding perimeter during the first four turns, the higher winding speed of the leech causes the rising of the boom 5 and the slackening of the spanker-boom 14.

This winding phenomenon lasts through about four turns, and over a boom axial length comprised between points A and B which represent a winding of close-wound thick layers resulting from the winding of the reinforcement of the clew 11.

After this first winding phase, the sail leech 13 is wound beyond point B over more loosely wound layers of sail. The new spires forming up from point B therefore tend to slide while compressing the sub-jacent layers of sail, and while slowing down the growth of the winding perimeter from one spire to the next, as illustrated in FIG. 5.

As a result, the winding speed of the leech which, initially, for covering up zone A-B, was higher than the winding speed of the hoist side 2, is substantially equal to the latter when the winding zone B-C has been covered. This generally corresponds to a winding operation of between eight to ten turns, whereupon it is found, as illustrated in FIG. 6, that the boom 5 has resumed its normal position.

But, thereafter, the winding perimeter spreading out beyond point C, increases less rapidly than the winding perimeter of the hoist side, so that the winding speed of the leech then becomes less than that of the hoist side.

At this stage in the winding, the boom 5 is once more suspended by the spanker-boom 14 which is stretched, so that the difference in the winding speed delays the winding of the leech which gradually slackens, as illustrated in FIG. 7.

The leech becomes slacker and slacker, the part of sail still set falls in, flapping in the wind, and is thrust towards the mast 2 along which vertical wrinkles 15 are spreading. The presence of these wrinkles 15, the flapping of the sail and of the leech make the last winding phase difficult, if not impossible for only one crew, and anyway delicate. In all cases, the winding produces wrinkles which are harmful for the sail, and often also, which can affect the conditions of its subsequent unrolling.

To solve this problem, anyone skilled in the art may consider applying to the boom 5 the technical solution used for eliminating the hollow forming when jibs are wound. One recommended solution to solve the problem consists in increasing the winding perimeter of the mandrel in the zone where the depression in the jib occurs. Instead of being strictly cylindrical, the jib-winding mandrel is spindle-shaped or comprises a localized extra thickness. This particular technique is taught by French Pat. No. 2 432 432 (78.23 656).

With such means, compensation of the winding speed occurs right from the first rotation of the mandrel.

But these means are not applicable to a winding boom, because the differential winding speed conditions which exist between the front part and the back part of the boom, as explained hereinabove, prove that the need to correct the winding perimeter is only felt once the balancing conditions have been restored, this occurring substantially at the tenth rotation of the boom.

In consequence, a technical disposition which would allow for a corrective attempt during the first ten rotations, would not really solve the problem of the actual slackening of the leech which starts between the tenth and the fifteenth rotations of the boom.

It is the object of the invention to propose means capable of solving this particular problem and capable also of causing an increase in the leech winding speed in order to keep said leech in a substantially stretched condition, this in order to eliminate any flapping of the rolled out part of sail, and to eliminate the vertical wrinkles forming along the hoist side, thus permitting a winding in good conditions, even with only one crew working either by hand and directly on the boom, or via remote-control means.

To this effect, the improvement according to the invention consists in providing one of the faces of the sail, and over at least part of the length of its leech, with a flat reinforcement which is thick with respect to the sail, and which is made from an elastically deformable material, said reinforcement being substantially constant in width and extending from the leech and in parallel thereto.

The invention will be more readily understood on reading the following description with reference to the accompanying drawings, in which.

Figure 1:
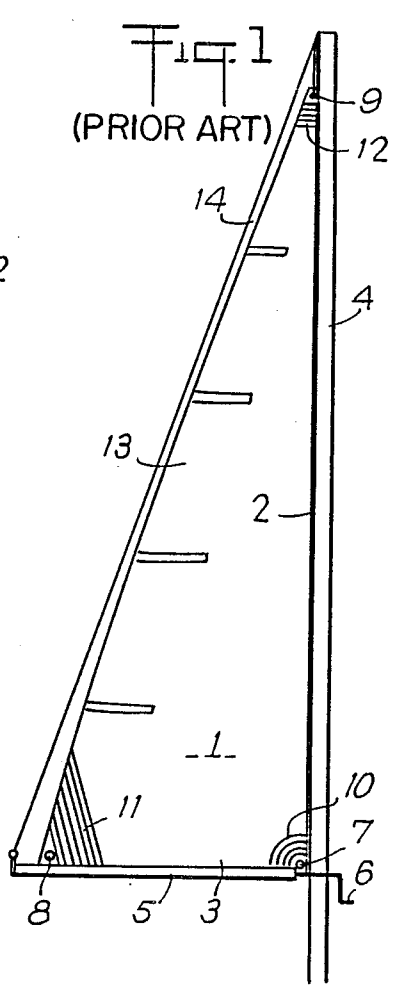
FIG. 1 (PRIOR ART)
FIG. 1 is a diagrammatical elevation of a conventional ssail.
Figure 4:
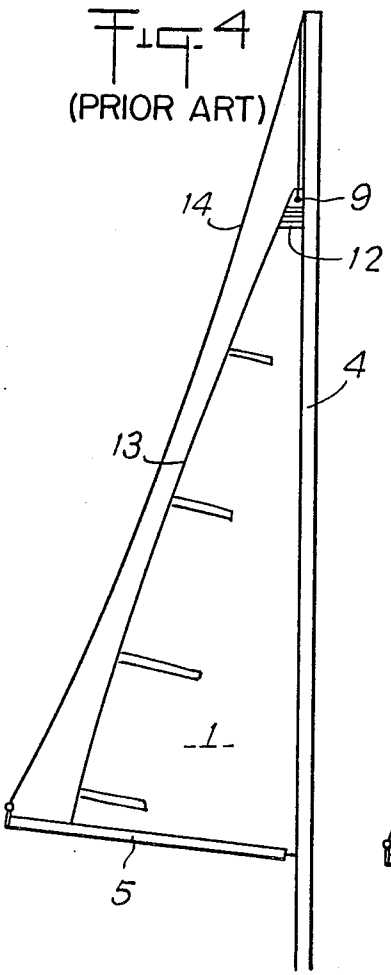
FIG. 4 (PRIOR ART)
FIG. 4 is an elevational view similar to FIG. 1, illustrating another phase in the winding of a conventional sail.
Figure 6:
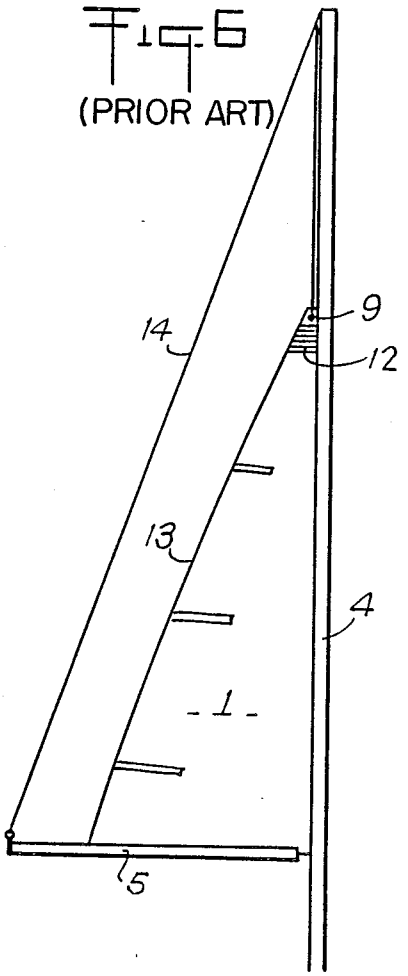
FIG. 6 (PRIOR ART)
FIGS. 6 and 7 are two side elevations illustrating two particular conditions in the winding of a conventional sail.
Figure 7:
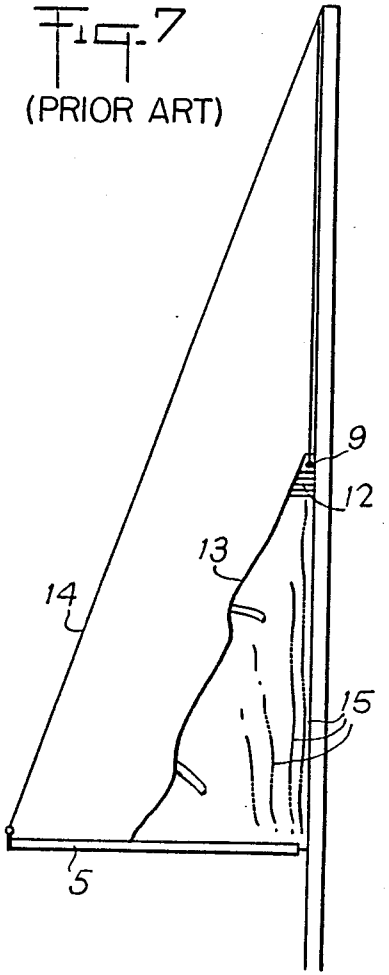
FIG. 7 (PRIOR ART)
Figure 2:
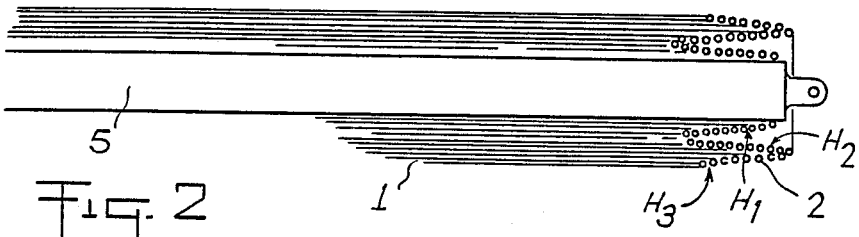
FIG. 2 (PRIOR ART)
FIGS. 2 and 3 are diagrammatical views showing, on an enlarged scale, two characteristic phases in the winding of a conventional sail.
Figure 3:
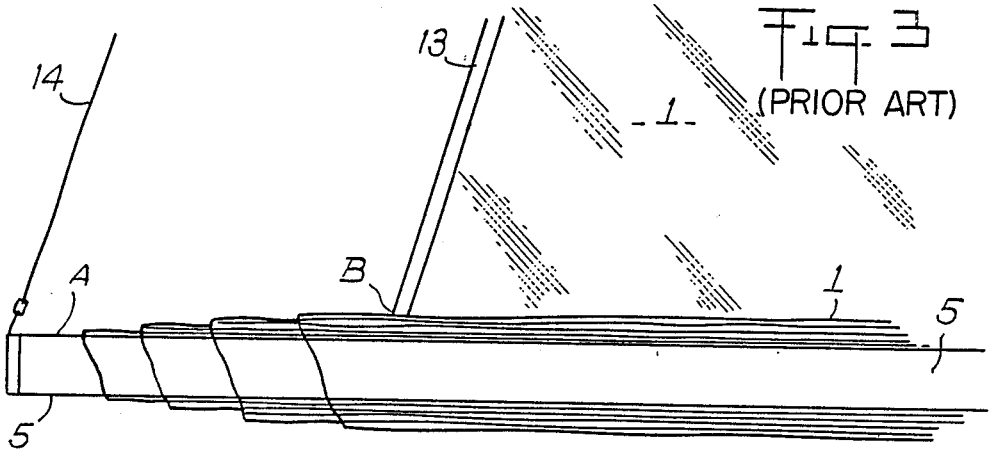
FIG. 3 (PRIOR ART)
Figure 5:
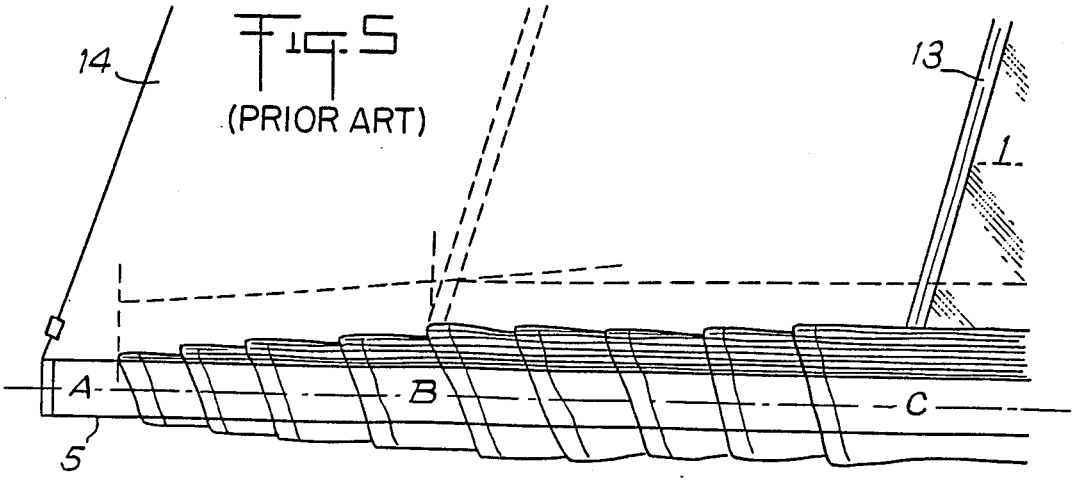
FIG. 5 (PRIOR ART)
FIG. 5 is a view similar to FIG. 3 showing clearly one characteristic feature in the winding of a conventional sail.
Figure 8:
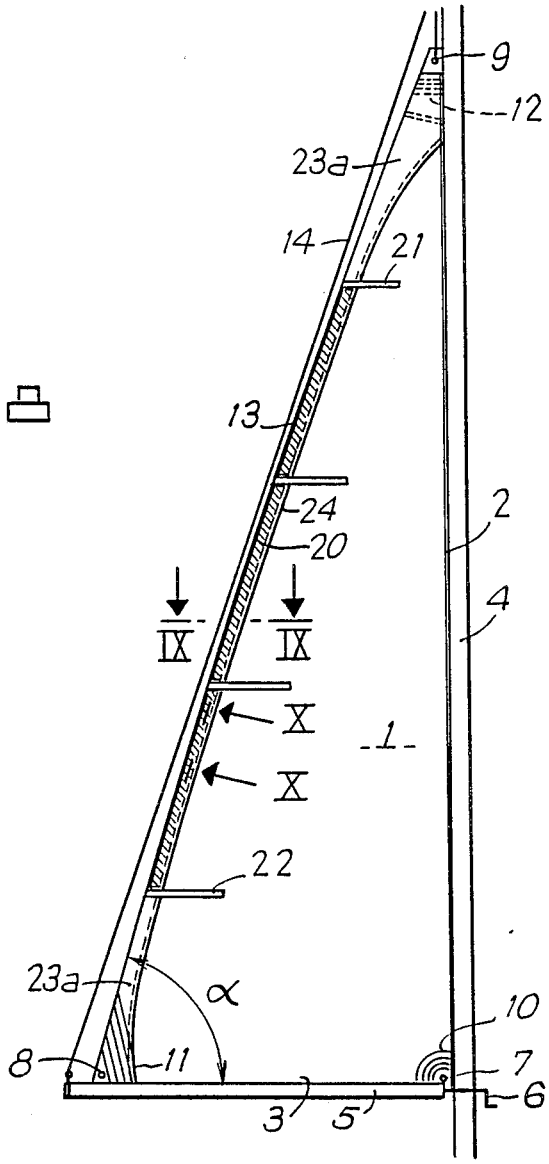
FIG. 8 is an elevational view showing, on an enlarged scale, the object of the invention.
Figure 9:
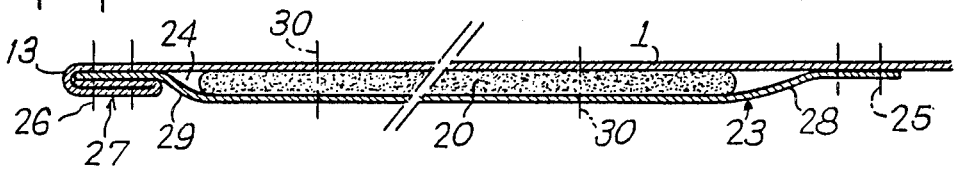
FIG. 9 is a cross-section on an enlarged scale, along line IX—IX of FIG. 8.

According to FIGS. 8 and 9, the improvement according to the invention consists in applying a flat reinforcement 20, over at least part of the length of the leech 13, against one of the two faces of the sail 1, said reinforcement being fairly thick in view of the thickness of the sail and spreading out from the leech 13 to a substantially constant width. Said reinforcement 20 is produced in an elastically deformable material, of low compressibility and constant thickness.

Said reinforcement 20 only covers part of the length of the leech 13 and more particularly, the part thereof in which the low winding speed creates the aforementioned slackening.

It has been found that, in order to efficiently settle the specific problem raised herein, the reinforcement 20 could spread between the extreme battens 21 and 22, normally provided on a sail to reinforce and stiffen, in the corresponding direction, the leech 13 and corresponding zone.

The thickness of reinforcement 20 is selected in such a way that, when it is wound in successive spires on the boom, starting substantially from point B, it causes an increase of the winding perimeter which results in a higher winding speed of the leech 13, capable of compensating the difference in speed with respect to the winding of the hoist side. The thickness of the reinforcement may vary between just a few millimeters and more than ten millimeters, depending on the characteristics of the sail.

Said reinforcement 20 may be fixed by any suitable means on one of the faces of sail 1 along the edge of the leech 13. One practical method is illustrated in FIG. 9 and consists in forming, with a strip 23 of the same material as the sail 1, a pocket 24 inside which said reinforcement 20 can be placed. Said pocket 23 may be fixed by seams 25 to the sail and by one or more seams 26 in the hem 27 bordering the leech 13. The pocket 24 is preferably constituted so as to allow the insertion of the reinforcement 20 while leaving soft and progressive junction zones 28 and 29 with the sail 1 and the leech 13, with a view to maintaining suitable aerodynamical properties in the trailing edge of the sail 1.

Reinforcement 20 may, optionally, be immobilized inside the pocket 24 by seams 30, and/or be adhesively bonded either to the sail 1, or to the strip 23. Preferably, the adhesive bond is only provided on one of the faces, which is selected to correspond to the outer face, on account of the winding of the boom 5.

It should be noted that the reinforcement 20 may be provided along the leech 13 in one piece or, on the contrary, be made up of successive segments inserted in a pocket 24 or in elementary pockets.

Figure 10:
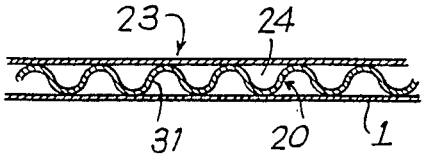
FIG. 10 is partial elevational cross-section, on an enlarged scale, along line X—X of FIG. 8 and illustrating a variant embodiment.

Preferably, reinforcement 20 is, constituted by a layer of closed-cell foam. It is however possible also, to select a layer of felt or a corrugated sheet or plate, such as illustrated in FIG. 10. The corrugations 31 then determine the compensating thickness which must be added on. In such a case, the reinforcement 20 is disposed so that corrugations 31 extend substantially in parallel to the rotation axis of the boom 5.

Said reinforcement 20 may have a width determined as a function of angle $\alpha$ formed by the leech 13 with the edge 3. A width of between 50 and 500 mm is possible. The selection of a width greater than the helical winding pitch of the leech, as determined by angle $\alpha$, will permit the reduction of the initial thickness of the reinforcement 20, considering that such a width makes it possible, for every winding turn, to compensate the winding perimeter for two successive spires.

FIG. 8 shows that the presence of the strip 23 may be advantageously used as a reinforcing edge for the leech 13. In such a case, said strip 23 can advantageously be extended by end parts 23*a* which spread beyond the part occupied by the reinforcement and even covers the reinforced zones 11 and 12.

The invention is in no way limited to the description given hereinabove and on the contrary covers any modification that can be brought thereto without departing from its scope.

What is claimed is:

1. Improvement in boat sails mounted on winding booms, of the type comprising a leech bordered by a reinforcing fold, a hoist side and an edge bordered by a bolt rope cord, and tacks, and a head, each one being reinforced by a plurality of locally overlaid thicknesses of cloth, wherein said improvement consists in providing one of the faces of the sail, and over at least part of the length of its leech, with a flat reinforcement which is thick with respect to the sail, and which is made from an elastically deformable material, said reinforcement being substantially constant in width and extending from the leech and in parallel thereto.

2. Improvement as claimed in claim 1, wherein said reinforcement is constituted by a layer of closed-cell foam.

3. Improvement as claimed in claim 1, wherein said reinforcement is housed in a pocket bordering the leech.

4. Improvement as claimed in claim 3, wherein said reinforcement is immobilized inside the pocket by a thin layer of adhesive.

5. Improvement as claimed in claim 1, wherein said reinforcement is constituted of plurality of segments.

6. Improvement as claimed in claim 3, wherein said reinforcement is contained in a pocket which spreads as a reinforcing element through the entire length of the leech, including the reinforcements of the head and the clew.

7. Improvement as claimed in claim 1, wherein said reinforcement spreads over part of the leech between the first and fourth battens.

8. Improvement as claimed in claim 1, wherein said reinforcement has a width at least equal to the mean pitch of the spiral winding of the leech on the boom.

* * * * *